United States Patent [19]

Schuss

[11] 4,015,548

[45] Apr. 5, 1977

[54] DISTRIBUTED PROGRAMMABLE CONTROL SYSTEM

[75] Inventor: Jack A. Schuss, West Hartford, Conn.

[73] Assignee: Combustion Engineering, Inc., Windsor, Conn.

[22] Filed: June 25, 1975

[21] Appl. No.: 590,389

[52] U.S. Cl. ..... 110/101 C; 236/14; 431/24; 122/448 R

[51] Int. Cl.[2] ..... F23K 3/00; F23N 1/00

[58] Field of Search ..... 236/14, 26; 431/24, 431/25, 26, 27, 28, 29; 110/28 R, 28 C, 101 C

[56] References Cited

UNITED STATES PATENTS

| | | | |
|---|---|---|---|
| 3,244,898 | 4/1966 | Hickox | 122/448 |
| 3,258,053 | 6/1966 | Schuss | 431/29 |
| 3,395,657 | 8/1968 | Schuss | 110/101 |
| 3,684,423 | 8/1972 | Bryant | 431/24 |
| 3,849,056 | 11/1974 | Schuss | 431/24 |

*Primary Examiner*—Kenneth W. Sprague

[57] ABSTRACT

A plurality of first logic processors are interconnected in a "ring" type network and individually exercise control over similar equipment group subsystems which individually contribute to the operation of an overall system. Each of the interconnected processors, in addition to its primary control function, monitors the safety of operation of the equipment group with which associated and the safety of operation of a "neighboring" equipment group. Redundant safety checks are thus performed on each equipment group and any discrepancies in the results of such safety checks are enunciated. A pair of further logic processors, in addition to performing other control functions including scheduling the operation of the individual equipment groups, redundantly check the safety of operation of the overall system.

5 Claims, 8 Drawing Figures

DISTRIBUTED PROGRAMMABLE CONTROL SYSTEM

BACKGROUND OF THE INVENTION

1. Field of the Invention

The present invention relates to the control of vapor generators and other devices of similar character. More specifically, this invention is directed to a digital control system for enhancing the availability of and efficiency and safety of operation of fossil fuel fired steam generators. Accordingly, the general objects of the present invention are to provide novel and improved methods and apparatus of such character.

2. Description of the Prior Art

The general state of the art with respect to automatic firing controls for coal burning furnaces is represented by the disclosure of U.S. Pat. No. 3,395,657 issued to J. A. Schuss on Aug. 6, 1968 and assigned to the assignee of the present invention; said U.S. Pat. No. 3,395,657 being incorporated herein by reference. The system of U.S. Pat. No. 3,395,657, which may be generally described as a "hard wired control", constituted a substantial step forward in the art when compared to the previous practice of operator exercised control over furnace start-up and shut-down.

It has been proposed to implement the control technique of U.S. Pat. No. 3,395,657 through use of a large general purpose plant computer which, in addition to burner start-up and shut-down supervision, monitors and controls numerous other functions within a power station; the furnace to be controlled typically providing steam for the driving of turbines connected to electrical generators.

Controls of the "hard wired" type have imposed a number of undesirable limitations on the designer and user. Thus, by way of example, all "hard wired" systems must be manually fabricated and installed and component damage resulting from wiring mistakes has been unavoidable. Further, shop simulation and field maintenance of "hard wired" systems is inefficient and expensive due, in part, to the need to follow a substantial number of wiring diagrams which are themselves generated at a rather high cost. A closely allied problem is the need to update all of these wiring diagrams after each logic modification or correction found necessary during simulation or field testing. Perhaps the major disadvantage of "hard wired" control systems, however, resides in the substantial difficulty of modification of the control once installed; i.e., "hard wired" controls are for all practical purposes inflexible. As a further significant disadvantage, increases in reliability realizable through the use of redundant circuits can be achieved in a "hard wired" control only at a comparatively high cost and the incorporation of means for self-checking the control systems and its components is thus both expensive and exceedingly difficult to implement.

The use of a plant installed general purpose computer for specialized control sub-loops such as coal mill; i.e., pulverizer; start-up and shut-down also possesses serious disadvantages. Bearing in mind that so-called "nuisance shutdowns" are extremely expensive to an electrical utility, use of a single large general purpose computer, perhaps with an equally expensive back-up computer, poses obvious functional and economic disadvantages. Thus, by way of example only, a failure in the computer or the power supply thereto totally unrelated to the apparatus being controlled would result in a "nuisance shutdown" in a system wherein the plant general purpose computer is utilized to control specialized ancillary equipment such as coal mills.

To summarize, the art has long needed a flexible and reliable method for exercising control over specialized operations which form part of the overall control procedure for coal fired furnaces of steam generators. The principal attributes of the desired control system are simplicity, ease of installation, self-checking capability, ability to directly interface with existing computer equipment to facilitate the monitoring of control system performance, minimum expense commensurate with successful and safe operation, virtual elimination of "nuisance shutdowns" and enhancement of plant availability.

SUMMARY OF THE INVENTION

The present invention possesses the above-described desirable attributes and thus constitutes a novel and improved firing control for coal and other fossil fuel fired furnaces. In accordance with the invention considering the applicability to a coal fired furnace, a plurality of logic processors associated with respective pulverizers are interconnected to define a unique control system. The logic processors, also known as programmable controllers, associated with the individual pulverizers exercise functional sub-loop control over the start-up and shut-down of the pulverizers. The control system of the present invention also employs additional logic processors to supervise the operation of an oil or gas fired furnace warm-up system and to exercise overall unit control.

The logic processors associated with the individual pulverizers, in addition to performing their control functions during start-up and shut-down, also monitor those factors which determine the safety of operation of their associated pulverizer and cross-check the safety status of one other pulverizer in the system. Thus, the logic processors which are directly associated with and control the pulverizers have the major portion of their capacity dedicated to the control function and additionally have two "redundant" portions of capacity reserved for pulverizer safety monitoring.

The present invention further envisions the use of comparators, which may either be within the pulverizer associated logic processors or included as separate components, for monitoring the results of the "safety" check performed on a single pulverizer by two of the logic processors. These comparators detect any disagreement between the safety status information generated by the two logic processor "safety" portions and enunciate such disagreement.

The overall "unit control" programmable controller or processor receives status signals from each of the pulverizer associated programmable controllers, such status signals being commensurate with the operational state of the pulverizers, and in response to such status signals and other input information regarding furnace operating parameters insures that all necessary precautions are taken when operating the furnace. The "unit control" also insures that no hazardous situations will arise as a result of equipment malfunction. The "unit control" generates status information for the central plant computer and, should the occasion arise, also generates a "trip" signal for the pulverizer associated controllers. Communication between the "unit control" and the plant central computer is one way in nature. The "unit control", as its primary function, delivers start and stop signals to the individual pulverizer associated logic processors to increase or decrease the number of burner elevations in service in the proper sequence as required by the loading on the power plant.

As noted above, a further programmable digital controller or logic processor is employed to supervise furnace warm-up. If the furnace is in a shut-down condition, the warm-up control will receive a start signal and, if the "unit control" is at that time generating a "permissive" control signal, the "warm-up" control will generate signals which control the operation of a oil or gas fired warm-up elevation. A portion of the capacity of the warm-up controller is reserved for redundant checking of the safety related furnace parameters monitored by the "unit control". By way of example, the "warm-up" control exercises flame failure protection and, in so doing, also duplicates a portion of the safety function of the unit controller.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENT

Figure 1:
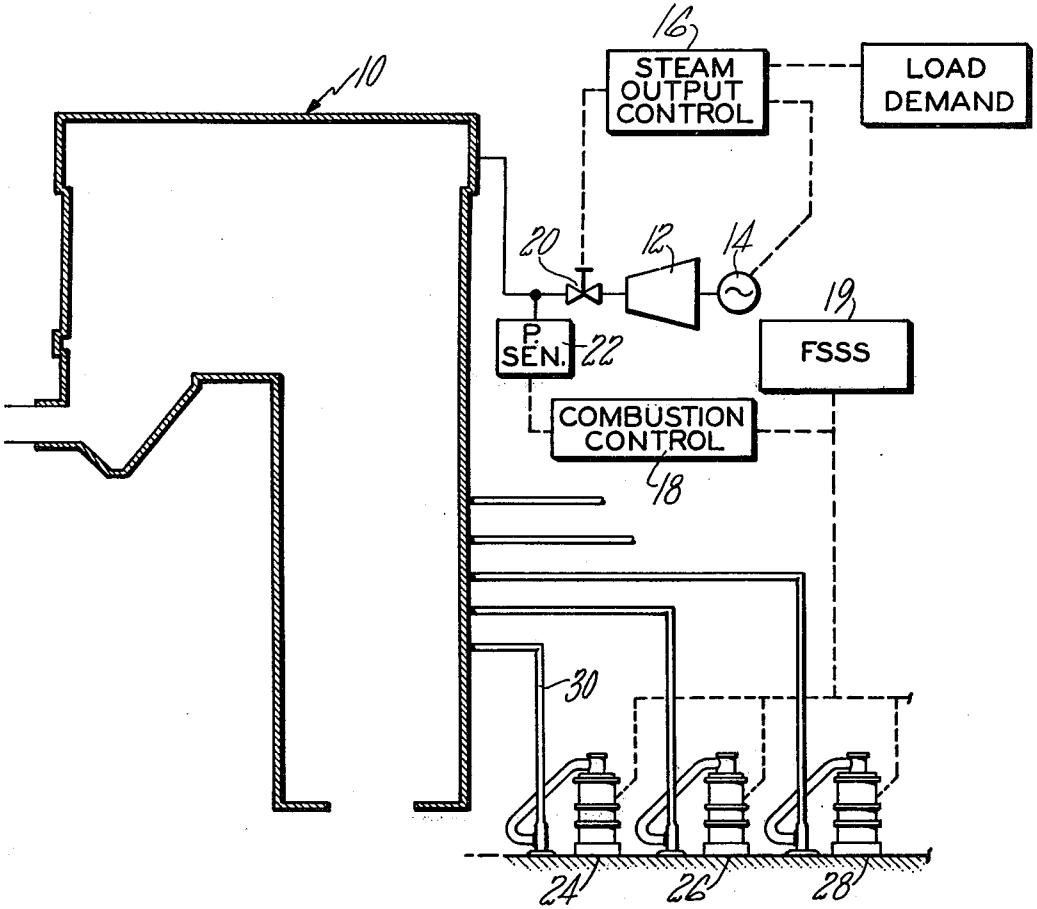
FIG. 1 is a partial schematic representation of a power plant of the general type with which the present invention may be employed, the control system of the present invention being depicted in FIG. 1 as a single component in the interest of facilitating understanding of the invention.

With reference now to FIG. 1, a furnace or boiler is indicated generally at 10. The furnace 10 includes a vapor generator, not shown, operatively connected to a steam turbine 12. The steam turbine 12 drives an electric generator 14. A steam output control 16 and a combustion control 18 are employed to adjust the output of furnace 10 in response to changing load demands on generator 14. Controls 16 and 18 are well known in the art, do not form part of the present invention and will not be described in detail herein.

As is well known in the art, the furnace 10 is lined with fluid conducting tubes within which high temperature vapor is created. This vapor, typically steam, is delivered to turbine 12 via a vapor regulating valve 20 controlled by steam output control 16. The pressure in the supply line to turbine 12 upstream of regulating valve 20 is sensed, by means of a pressure sensor 22, and delivered as the control input to combustion control 18. Combustion control 18 adjusts the flow of liquid to the conducting tubes within furnace 10 and also modulates the fuel input, by means of exercising control over a plurality of pulverizers or coal mills such as indicated at 24, 26 and 28, to satisfy the demand requirements of the turbine when the pulverizers are in operation.

The firing system for furnace 10 includes burner assemblies, not shown, which are typically arranged in elevations. Each elevation may include ignitors and fuel injectors disposed in each of the four corners of the furnace and adapted for tangential firing. The burner assemblies may be similar to those disclosed in U.S. Pat. No. 2,697,422. As may be seen from FIG. 2, which is a schematic representation of a typical firing corner, in the embodiment to be described the burners are employed in ten elevations. Burner elevations A through I consist of coal burners which are supplied with a pulverized coal-air mixture from associated pulverizers via coal supply lines such as line 30 associated with pulverizer 24. The coal-air mixture supply lines terminate at burner inlet valves which control the flow of coal to each of the burner-injectors.

Figure 2:
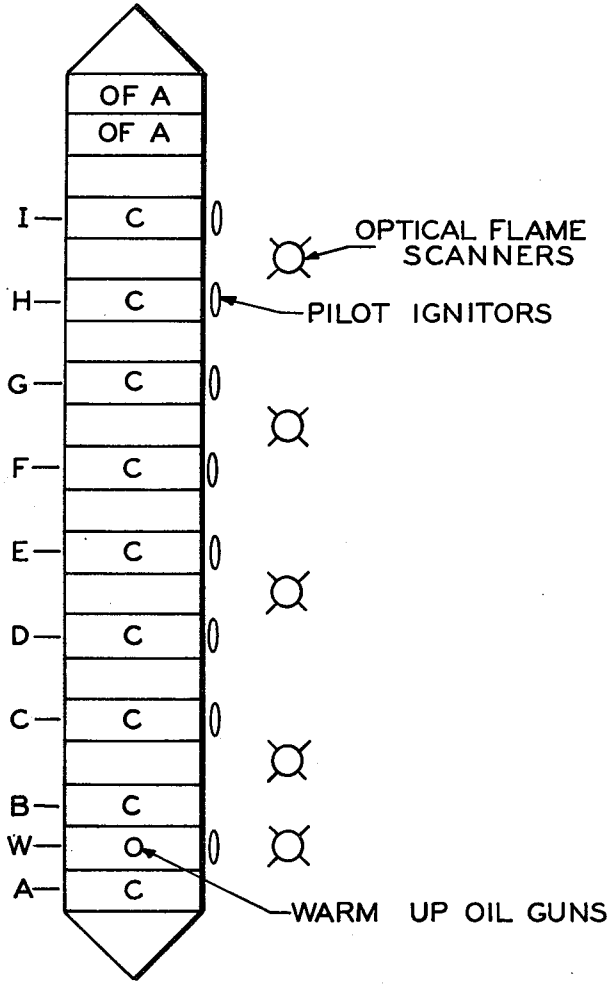
FIG. 2 is a schematic representation of a typical firing corner of the furnace depicted in FIG. 1.

The furnace 10 also includes an oil fired elevation indicated at W in FIG. 2. The oil fired burner elevation W, in the manner well known in the art, is employed for furnace warm-up. It is standard practice to initially warm-up a coal fired furnace using light oil as a fuel prior to start-up of the pulverizers.

Each of the burners of each elevation, with the possible exception of those situated on elevations A and B, will typically be provided with a pilot ignitor. The coal burners on elevations A and B may employ the warm-up oil guns as an ignitor. The warm-up oil guns at a elevation W will, of course, have their own ignitor. As indicated in FIG. 2, optical frame scanners are disposed at appropriate positions so as to detect the presence or absence of flame. The optical flame scanners thus provide important safety control information which will be delivered to the logic processors or controllers associated with the individual pulverizers. In FIG. 1 the control system of the present invention, which receives the inputs from the flame scanners as well as numerous other signals commensurate with operating conditions, is indicated at 19 as a furnace safeguard supervisory system (FSSS).

Figure 3:
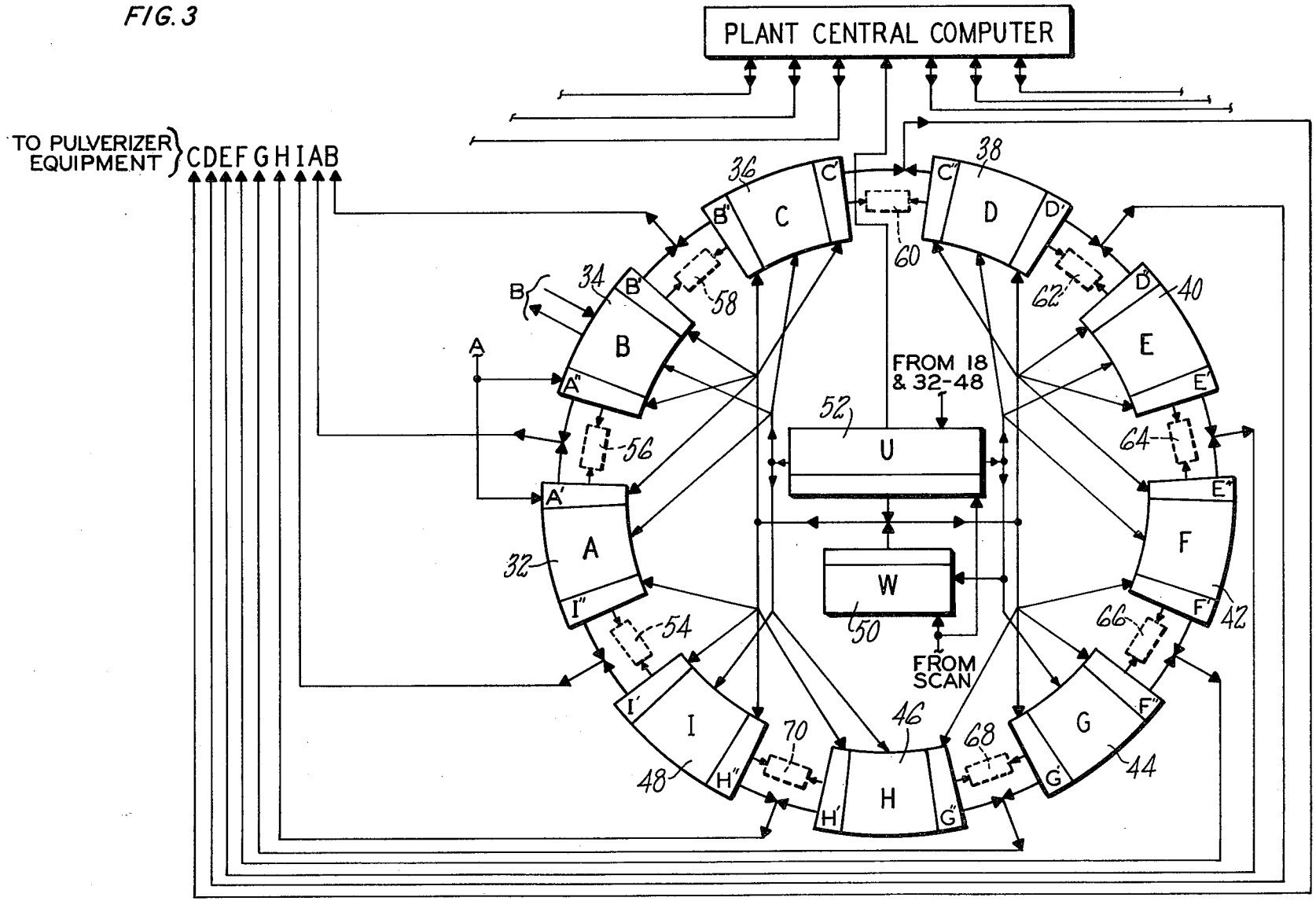
FIG. 3 is a functional block diagram of a preferred embodiment of the present invention showing the relationship between the plurality of logic processors.

The coal supply system; i.e., the coal pulverizing mills such as indicated schematically at 24, 26 and 28; are shown in substantial detail in FIG. 3 of above-referenced U.S. Pat. No. 3,395,657. The pulverizers receive coal from a collection hopper by means of a feeder. The feeder is driven by a variable speed motor which operates under the control of combustion control 18. The coal is fed, typically by gravity, from the feeder to a mill or pulverizer via flow control gate valves. Thus, the rate at which coal is supplied to the furnace is controlled by combustion control 18 which operates to vary the speed of the feeder drive motor and the setting of the gate valves. Preheated air is also supplied to the pulverizers. This heated air serves to dry the coal within the mills and to convey the pulverized coal to the burners. The latter function is effected by means of an exhaust fan. The supply of air to the pulverizer and the delivery of the pulverized coal-air mixture to the burners is controlled by power operated valves. The pulverizers are also provided with means, typically in the form of a cold air supply duct having a valve therein, for controlling the mill air temperature. A damper is positioned in the air supply line immediately upstream of the pulverizer for controlling the total air flow thereto; this damper also operating under the control of combustion control 18. Thus, in summary, each of the coal fired burner elevations A through I has associated therewith a pulverizer and each pulverizer is provided with an individual analog mill air temperature control (not shown). The volume of pulverized coal delivered to the furnace per unit of time from each pulverizer is, with the pulverizers in operation, modulated by combustion control 18 in accordance with the load demands on the system.

The present invention comprises means for safely, effectively and efficiently controlling the start-up and shut-down of the furnace by exercising control over the burner elevations, including the warm-up elevation, and effectively placing each elevation of coal burners in service automatically. The present invention also monitors the operation of the pulverizers and their associated burner elevations and commands appropriate remedial action whenever an unacceptable condition is believed to exist. It is to be emphasized that the present invention does not modulate the operation of the pulverizers and thus furnace output during operation with the exception that it places pulverizers in and out of service as a function of power plant load and pulverizer loading; the start-up and shut-down command signals for the pulverizers at each burner elevation emanating from the "unit control" which monitors the operational status of and thus the availability of the pulverizers.

Referring now to FIG. 3, a functional block diagram of the novel system of programmable controllers, depicted as element 19 in FIG. 1, in accordance with the present invention is shown. The controllers for the pulverizers associated with burner elevations A through I may be identical and will typically each comprise a programmable "mini-computer". These nine programmable controllers are indicated at 32, 34, 36, 38, 40, 42, 44, 46 and 48, respectively for burner elevations A-I. The warm-up control; i.e., the programmable controller associated with the oil-fired elevation W; is indicated at 50 and may be identical to controllers 32–48 with the exception that it will typically have a capacity which is double that of the "lower" controllers. The unit controller, indicated at 52, will also be identical to the other programmable controllers but will typically have a larger memory capacity, twice the capacity for example, when compared to controller 50. The programmable controllers 32–50 are commercially available logic processors such as, for example, a model 184 controller available from Modican Corporation, Bedford, Massachusetts.

The unit controller 52 insures that all necessary precautions are taken when operating the furnace and further insures that no hazardous situations will arise as a result of equipment malfunction. Thus, in response to input signals commensurate with the status of the pulverizer equipment groups in terms of operational state and availability for operation and input signals commensurate with the status of all auxiliary power plant equipment associated with fuel firing, the unit controller generators furnace "trip" signals and permissive signals for the warm-up and pulverizer associated controllers. The "unit control" processor 52 insures that prior to light-off furnace purge is completed, proper fuel pressure is established, sufficient air flow is available, equipment associated with fuel flow is in a shut-down status, etc. Also prior to light-off, the unit control 52 checks its own memory to determine whether the last shut-down was orderly in nature, or a result of an emergency trip. If the last shut-down was a result of an emergency trip, then there is a chance that the pulverizers still contain coal. The unit control 52 will, therefore, provide signals which cause the closing of all fuel nozzle inlet gates. This will prevent any pressure surge, developed by initial coal ignition, from forcing burning coal particles through the burner piping and into the idle, but coal laden mills. If all systems checked by the unit control 52 are in the proper state, unit control 52 will generate a "permissive" signal which will be applied to the warm-up control 50.

Subsequent to light-off, the unit controller 52 monitors all vital operating characteristics of the furnace, making sure that they are within safe limits. Any time safe operating limits are violated the unit control 52 will generate a "trip" signal. Loss of flame, inadequate furnace wall protection and loss of minimum air flow are examples of sufficient cause for the generation of a unit trip signal.

The unit controller 52 is programmed so as to avoid nuisance shut-downs while retaining maximum protection. In accomplishing these objectives the unit control 52 also exercises flame failure protection both during the initial light-off or start-up and during operation. The safety check functions of the "unit" control processor 52 are duplicated by a portion of the capacity of warm-up controller 50 thus giving the system desirable redundancy. Considering the flame failure protection, the results of the safety checks performed by controllers 50 and 52 are "OR" ed. The controllers are programmed so that a "trip" will not occur if a self-check indicates a controller failure rather than a flame failure; i.e., the tripping function is positive in nature. This, of course, avoids nuisance shut-downs as a result of controller failure or power loss.

The warm-up control computer 50, as noted above, supervises the operation of an elevation of oil guns and associated ignitors. The oil guns are designed for mechanical or air atomization of fuel delivered to the furnace. In the case of mechanical atomization the supply line to each individual oil gun is equipped with a manual shut-off valve, a power operated shut-off valve and a pressure switch. A pressure or gun proving switch indicates pressure loss downstream of the shut-off valve such as caused by leakage, a faulty coupling or a bad tip connection. Each oil supply line also includes a purging steam connection; the purging steam supply also being equipped with a power operated shut-off valve, a check valve and a manual shut-off valve. Each of the warm-up oil guns further includes a gun retract mechanism, which is used to back the guns out of exposure to high furnace temperatures when not in use, and associated limit switches.

Upon receipt of a permissive signal, generated by "unit" control 52, and a start signal provided by an operator in a manual control mode or provided by the "unit" control in the automatic control mode, the warm-up control 50 generates a control signal which first starts the ignitors and thereafter the associated oil guns at warm-up elevation W. It is a primary prerequisite of the system that the ignitors go into service first and that their operation be proven. No ignitor is allowed to go into service unless its flame proving differential pressure switch is properly functioning and initially providing a "no flame present" signal. The "start-up" command for the warm-up elevation also energizes the ignitor air booster fan. Once ignition is established and all "start-up" prerequisites for the warm-up guns are satisfied, the oil guns will be advanced into the furnace and, when advance is completed, the oil supply valve will be opened.

When the warm-up portion of the start-up cycle is completed, as indicated by signals provided by temperature sensors appropriately located in the furnace, signals will be generated by "unit" control 52 which selectively and sequentially enable the programmable controllers 32–48. The enabled controllers will, in the manner to be described below, thereafter automatically start the pulverizers and their associated burners in a predetermined elevation sequence. The warm-up oil guns will remain in the on condition until ignition of the coal fired burners of elevations A and B is proven since the warm-up oil guns are utilized as ignitors for these two coal fired elevations in the embodiment being described.

Oil gun shut-down, under the control of warm-up computer 50, is accomplished in a manner similar to start-up. During shut-down, the ignitors are reenergized to support a scavenging cycle and the oil guns are removed from service. The shut-down procedure includes complete purge of each oil gun and, when purging has been completed, the oil guns are automatically retracted. At the end of the purge cycle the ignitors are removed from service.

Each of the programmable controllers 32–48 is "divided" into three parts or, more precisely, each of the pulverizer control computers has its internal capacity divided between a plurality of control functions. The first or principal function is concerned with the control of the associated pulverizer during start-up and shut-down. The second section or function is devoted to checking the safety of operation of the associated pulverizer. The remaining portion of the capacity of each machine performs a safety check on a neighboring pulverizer. In the system of FIG. 3, considering controller 32 for burner elevation A as an example, the center section or major portion of the capacity of the computer is devoted to the principal control function. The portion of the machine schematically represented at A′ performs the safety checking function. The portion of the capacity of programmable controller 32 schematically represented at I″ performs a safety check on the pulverizer associated with controller 48. The same nomenclature as described immediately above is employed for each of programmable controllers 34–48. This "ring-type" arrangement results in having one computer control section available per pulverizer and two redundant safety sections per pulverizer. The results of the safety check performed on each pulverizer by pairs of programmable controllers 32–48 are compared by means of comparators 54–70. These comparators may be separate components, as indicated in FIG. 3, but in most cases the comparison function will be performed by a portion of the safety check logic of one of the programmable controllers 32–48. The comparators 54–70 detect any disagreement between the results of the monitoring function performed by the safety sections of the two neighboring controllers, from an electrical circuit viewpoint, and enunciate this disagreement. The safety check and comparison functions will be described in greater detail below in the discussion of FIG. 6.

Before continuing with a discussion of the interrelationship of programmable controllers 32–48, a brief description of the principal control function performed by each of these logic processors is believed to be in order. The main function of controllers 32–48 is to supervise the start-up, shut-down and operational monitoring of an associated pulverizer and its ancilliary equipment (the pulverizer equipment groups). Thus, each of controllers 32–48 controls the start-up and shut-down functional sub-loops for the pulverizer associated with a coal-fired burner elevation and, during firing of that elevation; monitors the operation of the pulverizer and its associated equipment. The controllers 32–48 do not modulate the coal supply to the pulverizers while in operation.

Figure 4A:
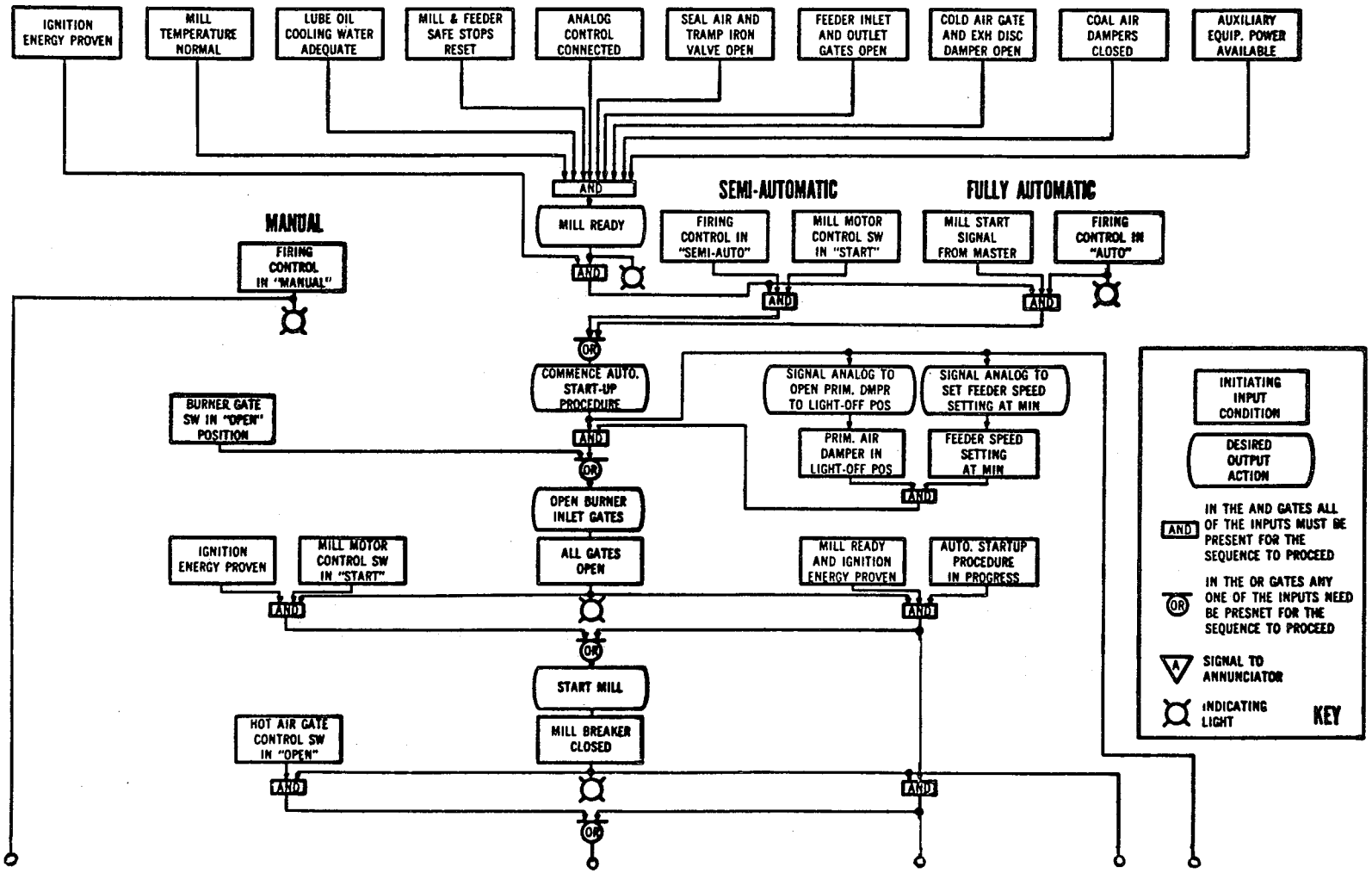
FIGS. 4A and 4B are a simplified functional block diagram depicting a portion of the start-up program exercised by each of the coal mill associated processors shown in FIG. 3.
Figure 4B:
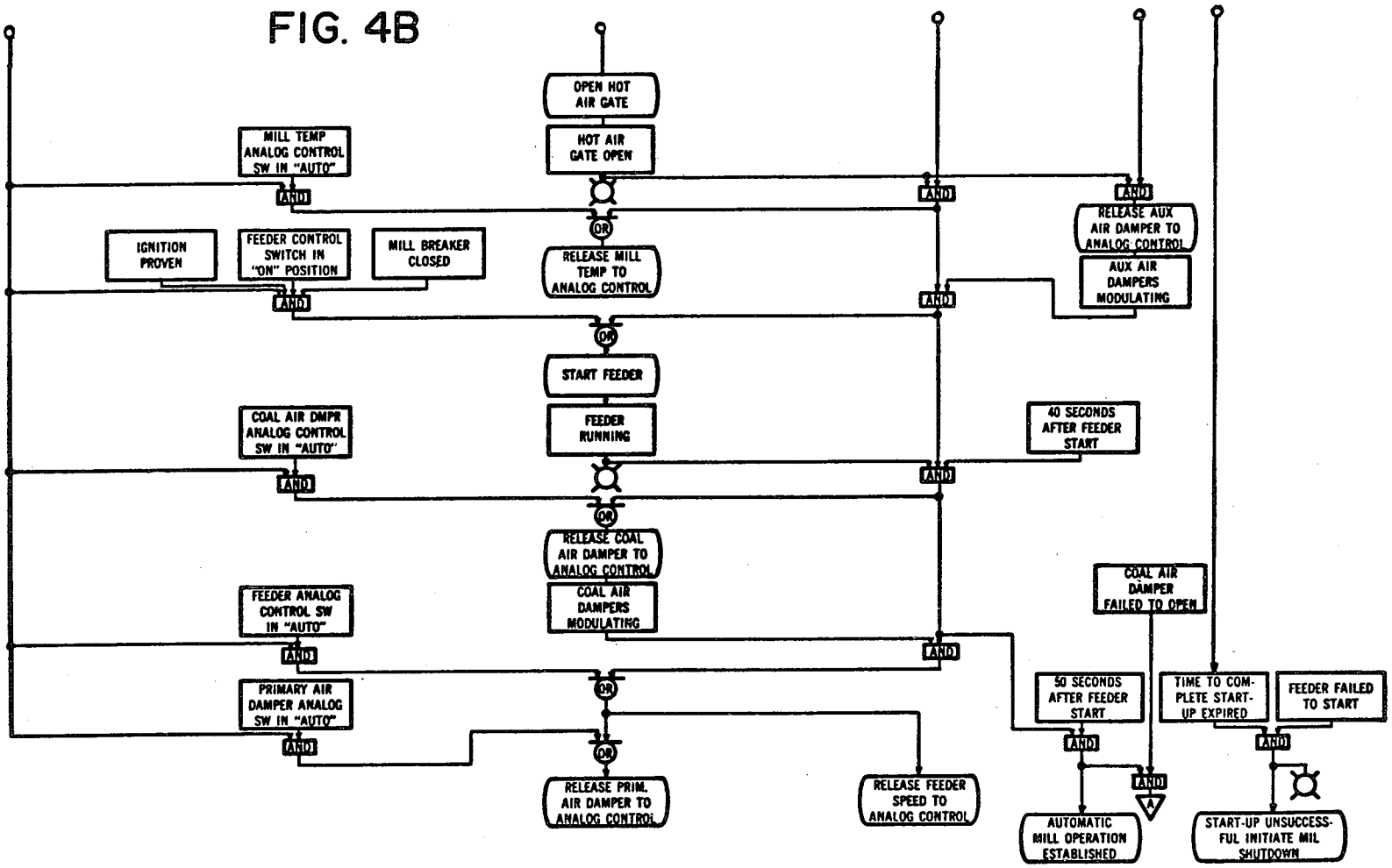

Referring to FIG. 4, a simplified functional block diagram of a portion of the start-up sequence for one coal mill (pulverizer) is depicted; the ignitor control function having been omitted from the drawing. FIG. 4 also indicates the parameters which are sensed and delivered to each of programmable controllers 32–48 so that it may perform its functional sub-loops. Those inputs have been shown schematically in FIG. 3 only in the case of processor 34. The initiating signal for each coal fired elevation is provided by an operator controlled switch in the manual mode or by "unit" control 52 in the automatic control mode. After ignition energy has been proven, regardless of the mode of operation, a start-up command will be "cleared" through logic which performs a safety interlock function to determine whether the pulverizer is in the ready position. The "mill ready" status is a summation of conditions verifying that if manual maintenance operations had taken place, these are now completed and the system has been checked out; i.e., isolating dampers have been reopened, safe stop switches reset, power is available, etc. The safety interlock logic also confirms that sufficient measured ignition energy is available for coal light-off and that this energy is being maintained throughout the start-up cycle. Thereafter, the feeder speed set point is set at minimum and the primary air dampers are opened to the light-off position. After confirmation in the form of feed back signals is received verifying completion of these functions, the coal nozzle inlet gates are opened, the pulverizer motor is started and the hot air gate valve is opened. Upon completion of these operations an analog control associated with the pulverizer is instructed to commence mill temperature control and to start modulation of the cold air inflow dampers. The next step is start-up of the coal feeder followed by release, to automatic modulation by combustion control 18, of the coal-air dampers, primary air damper and feeder speed. Throughout the start-up procedure the programmable controllers insure that a preselected time table is kept and, should serious excursions from the time table occur, alarms will be sounded. If the start-up of any elevation is unsuccessful, shut-down of equipment already energized will be initiated and the "unit" control 52 will be "notified". Thus, to summarize, during the start-up operation the programmable controllers associated with each pulverizer will function in the same manner as the "hard wired" circuit of FIG. 8 of referenced U.S. Pat. No. 3,395,657.

Figure 5A:
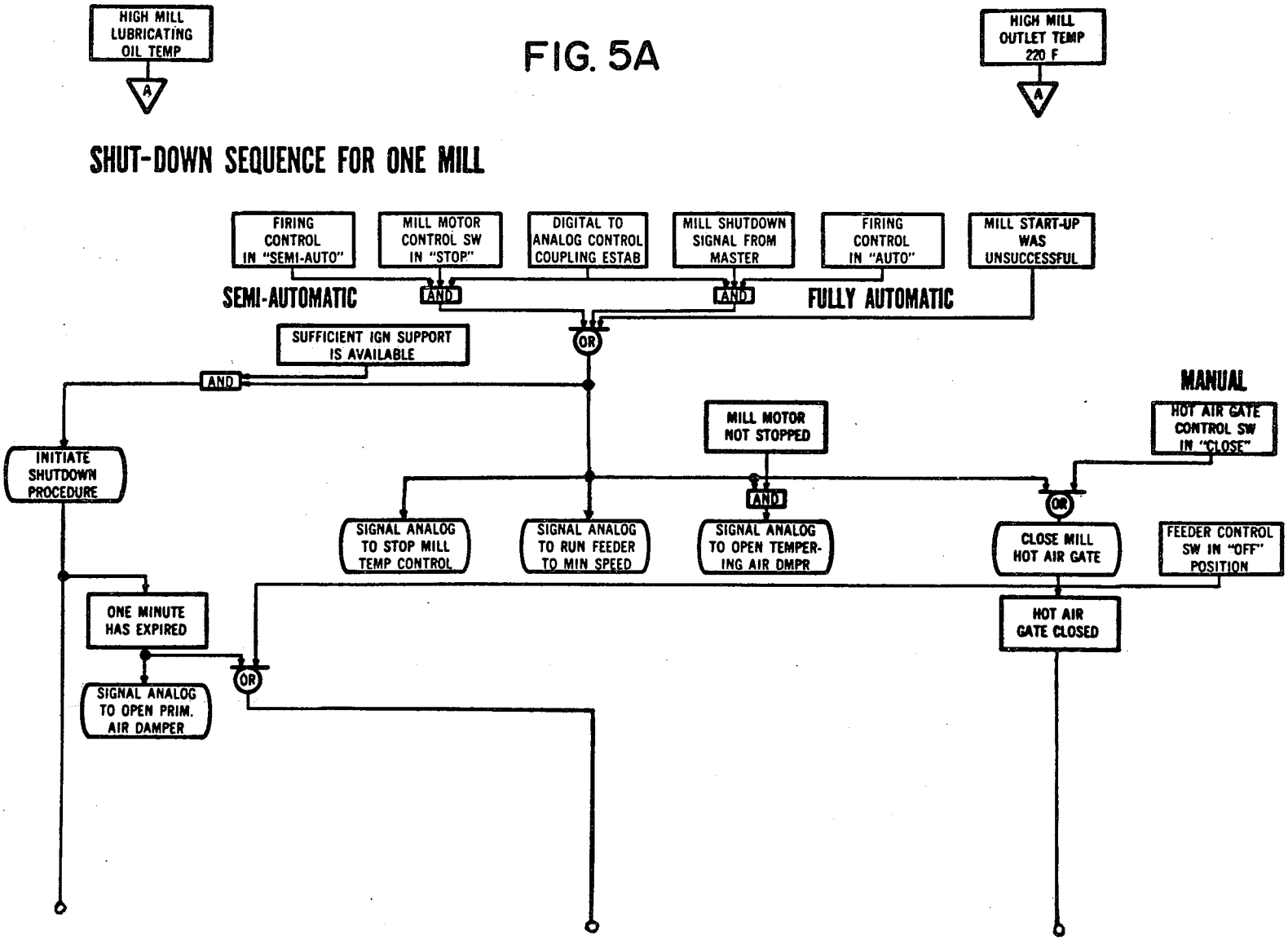
FIGS. 5A and 5B are a simplified functional block diagram of the shut-down program exercised by each of the coal mill associated processors of FIG. 3.
Figure 5B:
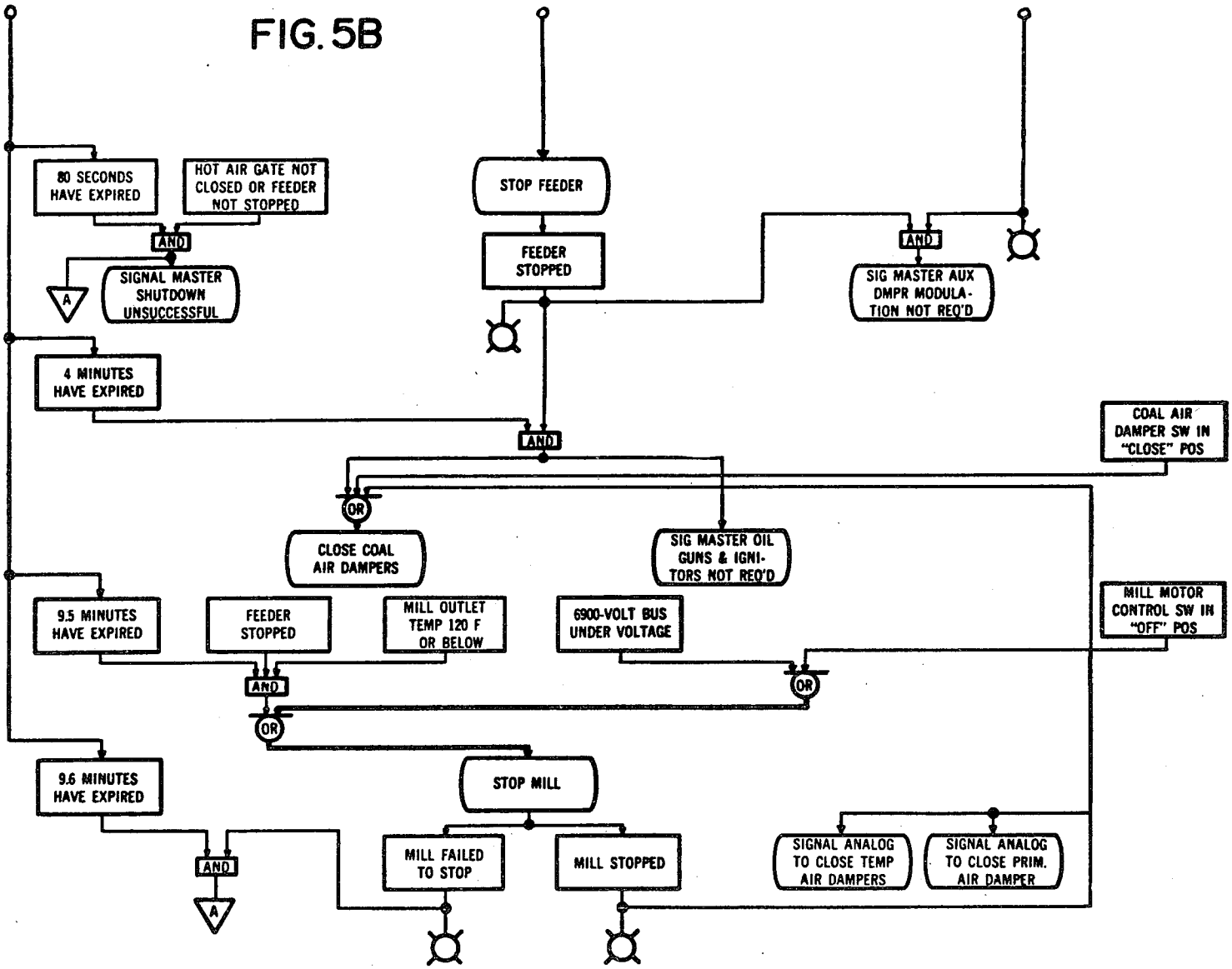

As represented by the functional block diagram of FIG. 5, pulverizer unit shut down is accomplished in a manner similar to start-up. The functional sequence for pulverizer shut-down, which is shown in a simplified form in FIG. 5, is well understood in the art and will not be further described herein.

To briefly summarize the above discussion, the present invention includes a unique interdependent arrangement of programmable controllers or logic processors. The pulverizer equipment group associated with each coal-fired elevation of a vapor generator furnace is controlled, during start-up and shut-down, by a single one of these controllers. Additionally, as will be further discussed below in conjunction with the description of FIG. 6, each controller monitors, from a safety viewpoint, the operational status of its associated coal mill and the operational status of the coal mill associated with another elevation. The two operational status checks, or more precisely the results of the two safety computations performed with respect to each pulverizer equipment group, are compared and any discrepancies enunciated.

The control system and technique of the present invention also includes a "unit" control and a warm-up control. The "unit" control and warm-up control redundantly receive information commensurate with a status of all of the pulverizer equipment groups, the outputs of the furnace flame scanners and status information regarding all other power plant fuel firing auxiliary equipment. The "unit" and warm-up controllers are interconnected in a redundant safety check arrangement whereby a portion of the capacity of each machine is dedicated to determining the necessity of ordering a furnace trip.

The "unit" control logic processor 52 is dedicated to functions pertaining to overall unit control including furnace purge, detecting, interpreting, and, as briefly discussed above, acting upon a number of unit trip conditions and providing overall furnace flame failure protection. Thus, in addition to its safety check functions, the "unit" control will establish elevation start permissive conditions and coordinate the placing of individual pulverizer equipment groups in service and coordinate the removal of individual pulverizer equipment groups from service.

In performing its assigned coordinating functions, logic processor 52 must respond to increased load demand, as indicated by combustion control 18, when the average mill loading reaches a high limit by initiating the start-up of successive pulverizer units. In making selections as to which pulverizer unit should be placed next in the start-up cycle, logic processor 52 will act upon information, fed back from the controllers in the "ring", commensurate with the availability of the individual pulverizer equipment groups and also upon a stored program commensurate with the preferred start-up sequence. Some of the available input information; i.e., which pulverizers are already in service, which pulverizers are locked out for maintenance and which elevations do not have supporting ignition energy available; is scanned initially but some decisions can be made only as the control process progresses. Logic processor 52 must, therefore, adapt itself to changing equipment status, following alternate control routines, until successful start-up is accomplished.

The logic processor 52 generates periodic initiation pulses. These pulses are delivered simultaneously to all of the pulverizer associated logic processors, but only one pulverizer equipment group at a time is allowed to accept the signal. The pulse frequency is such that when a logic processor dedicated to a given pulverizer equipment group accepts the initiation signal, the "unit" control is able to scan the results by the time the next pulse is generated. A similar procedure is followed on decrease of load demand. Should logic processor 52 fail, the operation of all pulverizer equipment groups will revert automatically to a semi-automatic mode.

The two "center" logic processors; i.e., programmable controllers 50 and 52, are thus continually conversing with the pulverizer equipment group associated controllers on the perimeter of the "ring" and are sending out a limited number of instructions as required for both control and safety. The "unit" and warm-up controllers provide a redundant safety-check on the overall furnace operation.

The warm-up control logic processor 50, in addition to the input signals received in parallel with those delivered to the "unit" control so as to enable performance of the safety function, receives a permissive signal from "unit" control 52 and feedback signals which enable processor 50 to exercise proper control over the furnace warm-up cycle. During the warm-up cycle the oil gun ignitors will go into service first since a primary prerequisite for placing an oil gun in service is that the associated ignitor is on and proven. No ignitor, however, is allowed to go into service unless its flame proving sensing element is properly functioning. Once ignition is established, oil guns will be placed in service at preselected intervals and each oil gun is monitored to make sure that all start-up prerequisites are satisfied. If the starting prerequisites are satisfied, the oil gun will be advanced and, when advance is completed, the oil supply valve will be opened. When sufficient time has elapsed to place all warm-up oil guns in service, a counting circuit is activated. If and when the counting circuit finds the number of successfully operating oil guns at a given elevation adequate, a signal may be generated that sufficient ignition energy is available to permit start-up of an adjacent pulverizer unit. Oil gun shut-down is accomplished in a manner similar to start-up; the shut-down procedure including complete purging of each oil gun.

Figure 6:
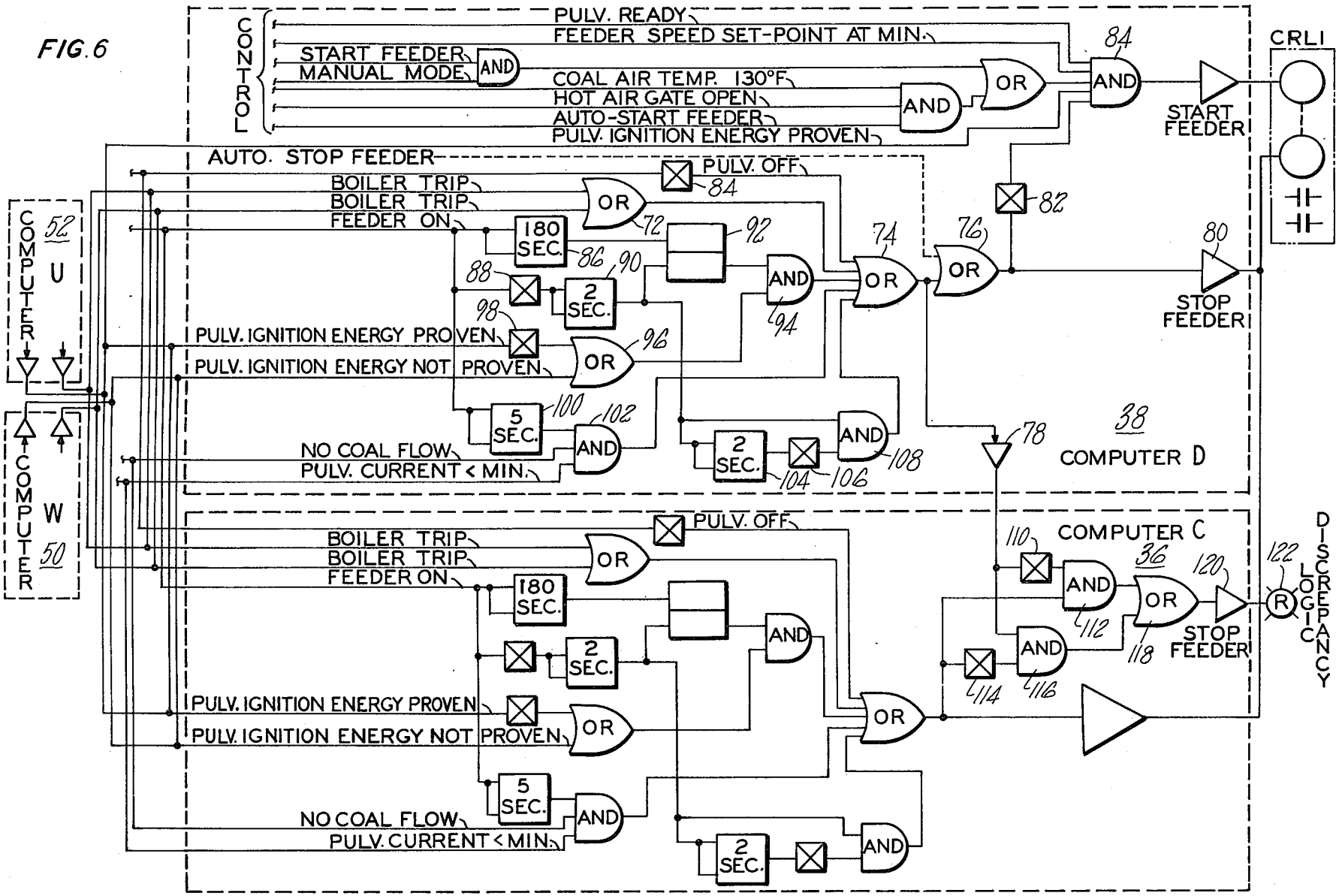
FIG. 6 is a functional block diagram of portions of two of the coal mill associated processors of FIG. 3, FIG. 6 depicting the redundant safety check feature of the present invention.

FIG. 6 is a partial functional block diagram of a pair of the logic processors on the perimeter of the "ring" which exercise the start-up and shut-down control over a pair of pulverizer equipment groups. For purposes of explanation, it may be considered that the processors depicted in FIG. 6 are controllers 36 and 38 of FIG. 3; these two computers being associated by virtue of a redundant safety check on the pulverizer associated with the coal fired burners at elevation C. Controllers 36 and 38 are also both connected, as shown in FIG. 6, to and receive inputs from the "unit" control processor 52. Controllers 36 and 38 additionally receive status signals fed back from the equipment they respectively control.

Considering controller 36, a part of the start-up control function logic is depicted at the top of FIG. 6. This portion of the control function logic, which controls the start-up of the coal feeder for the pulverizer, will not be described further herein. The redundant safety check for the pulverizer controlled by processor 36 is performed in response to a plurality of input signals received from warm-up control 50, "unit" control 52 and from sensors mounted directly on the coal mill. Thus, as indicated on FIG. 6, coal mill mounted sensors provide input signals to the redundant safety check section of programmable controller 36 and simultaneously also to the safety check logic portion of controller 38, in accordance with the following parameters:

Pulverizer status;
Feeder status;
Coal flow status; and
Pulverizer motor current less than a predetermined minimum.

The safety check logic in programmable controllers 36 and 38 also receives, from the warm-up computer 50, a signal indicating that the pulverizer ignition energy has not been proven and a boiler trip command signal. The safety check logic in controllers 36 and 38 receives, from the "unit" controller 52, signals commensurate with a boiler trip command and a signal indicating that pulverizing ignition energy has been proven.

The safety check logic of programmable controllers 36 and 38 is, as indicated in FIG. 6, identical with the exception that a portion of the controller logic in processor 36 is dedicated to the comparison function attributed to comparator 60 of FIG. 3. The manner of performing this comparison will be described in greater detail below. Continuing with a discussion of the safety logic of processor 38, the signals commensurate with boiler commands generated by the redundant safety logic in warm-up controller 50 and "unit" controller 52 are delivered to an OR gate 72. The output of OR gate 72 is delivered as an input to a further OR gate 74. The output of OR gate 74 is applied as the input to an output driver amplifier 78 for the comparison purposes to be described below. The output of OR gate 76 is applied as an input to an output driver amplifier 80 and, via an inverter 82, as an input to an AND gate 84 in the control logic portion of processor 38. Thus, it may be seen that amplifier 80 will provide a "stop feeder" output signal if the inputs received by the safety check logic of processor 38 from either of the "unit" or warm-up controllers 52 and 50 indicate a boiler trip condition.

An input signal commensurate with the "on" status of the pulverizer is inverted, in an inverter 84, and delivered at a second input to OR gate 74. This second input to OR gate 74 thus indicates that the pulverizer is in the "off" condition and, accordingly, via OR gate 76 and amplifier 80, the sensing of a pulverizer off signal will also result in the generation of a "stop feeder" signal.

A signal from the pulverizer indicating that the coal feeder is in the "on" condition is delivered to a first time delay circuit 86 and, via an inverter 88, to a second time delay circuit 90. Time delay circuit 86 will typically pass only signals of duration in excess of 3 minutes; i.e., circuit 86 will provide an output only after the coal feeder has been running for a period of 3 minutes. Time delay circuit 90 will typically pass signals of duration in excess of two seconds and thus will provide an output signal any time the coal feeder has been in the "off" condition for more than two seconds. The output of time delay circuit 86 is employed to set a bistable circuit 92; this bistable circuit being reset by the output of time delay circuit 90. Bistable circuit 92 will provide an enabling input to AND gate 94 only when the coal feeder has not been on more than three minutes.

A second input to AND gate 94 is provided by the output of an OR gate 96. The inputs to OR gate 96 are provided from the warm-up and "unit" controllers. That is, a signal commensurate with pulverizer ignition energy not proven will be applied as a first input to OR gate 96 from warm-up controller 50. A second signal commensurate with pulverizer ignition energy not proven will be an ignition energy proven signal from "unit" controller 52 which is inverted by an inverter 98. AND gate 94 will, accordingly, provide an output to OR gate 74 when the coal feeder has not been on for more than three minutes and there is no ignition energy. This signal, also via OR gate 76 and amplifier 80, will cause the generation of a "stop feeder" signal. The delay circuit 90 is incorporated to preclude the generation of a "stop feeder" signal upon the occurrence of such events as short duration power interruptions.

The "feeder on" signal is also delivered to a further delay circuit 100 which provides a first or enabling input to an AND gate 102 when the feeder has been on for a period in excess of five seconds. Additional inputs to AND gate 102 are the "no coal flow" and "pulverizer current less than minimum" signals provided from sensors at the pulverizer. The output of AND gate 102 is also applied as an input to OR gate 74 for the purpose of generating a "stop feeder" signal.

The output of delay circuit 90 is applied to a further delay circuit 104 and as an enabling output to an AND gate 108. The second input to gate 108 is the output of delay circuit 104 as inverted in an inverter 106. AND gate 108 thus provides an output pulse to OR gate 74; trip signals delivered to amplifier 80 thus being pulses of two seconds duration rather than sustained signals as long as the control system is energized. This mode of operation precludes, as a side effect to a legitimate or necessary "trip ", prevention of a subsequent normal start-up.

Perusal of FIG. 6 will indicate that the safety logic of programmable controller 36 is identical to that of controller 38 and that the outputs of the safety-check logic portions of these two controllers are paralleled whereby an indication of the need for the stopping of the pulverizer coal feeder at elevation C as provided by either of controllers 36 or 38 will produce the necessary protective action.

A comparator circuit comprising inverters 110 and 114, AND gates 112 and 116 and OR gate 118, provides, via an output driver amplifier 120, a signal indicative of the fact that there is a discrepancy in the results of the safety check performed by controllers 36 and 38. Thus, any time the output of only one controller of an associated pair is a "stop feeder" signal, a warning lamp 122 will be energized thus alerting personnel to the fact that a controller malfunction may exist.

To summarize the attributes of the present invention, the failure of any logic processor in the "ring" affects its associated pulverizer equipment group only. Furthermore, since a "neighboring" logic processor is monitoring the important safety aspects of the pulverizer equipment group, an already running pulverizer does not have to be shut-down because its controller has failed unless the "neighboring" processor has also failed. Processor and interface maintenance can, therefore, be accomplished with the pulverizer equipment group associated with a failed processor in operation.

The present invention is also characterized by simplicity of modular arrangement since all logic processors in the "ring" have identical programs. In contrast with centralized computer installations, the control system of the present invention avoids priority problems and there is no dependency on mechanical or mass memory storage devices. Also, programming time is reduced to initial set up of the present invention. In use, switch-over problems as often occur between primary and backup computers are eliminated. Further, there is ease of interfacing with the power plant central computer and such interfacing makes the processors satellites of the main plant computer. When compared to hard-wired systems, field maintenance of the present invention is substantially simplified since processor card failure modes bear no relation to specific logic functions. Consequently, there is no need for field personnel to try to match a logic malfunction with a wiring diagram.

While a preferred embodiment has been shown and described, various modifications and substitutions may be made thereto without departing from the spirit and scope of the invention. Thus, by way of example, while the invention has been described above in terms of controlling coal mills in a furnace safeguard supervisory system, the invention is applicable to the control of an air quality control $SO_2$ removal scrubber management system. In such a system the logic processors at the center of the "ring" would be dedicated to control of overall unit functions and to the control of the additive preparation system respectively. The logic processors on the perimeter of the "ring" would be dedicated to control of the individual scrubber modules. Thus, it will be understood that the present invention has been described by way of illustration and not limitation.

What is claimed is:

1. A sub-routine control system for use with a fuel consuming apparatus, the apparatus including a plurality of similar groups of ancillary equipment which contribute to overall system operation, the apparatus further including sensors which provide signals commensurate with conditions which influence safety of operation, each ancillary equipment group being provided with a plurality of sensors for monitoring operating parameters and generating signals commensurate therewith, said control system comprising:

a first programmable controller, said first programmable controller being connected to receive signals commensurate with the operational status of said ancillary equipment groups, said first programmable controller generating command signals for said equipment groups in response to said operational status signals and in accordance with stored instructions whereby said equipment groups will be operated in accordance with a schedule, said first programmable controller also being connected to receive the signals commensurate with the sensed conditions which influence the safety of operation of the apparatus and generating a shut-down signal for the apparatus when said safety signals indicate that an unsafe operating regime is being approached;

a second programmable controller, said second programmable controller being connected to receive the signals commensurate with sensed conditions which influence the safety of operation of the apparatus and generating a shut-down signal for the apparatus when said safety signals indicate that an unsafe operating regime is being approached;

means delivering the signals commensurate with sensed operating conditions which influence the safety of operation of the apparatus to said first and second programmable controllers;

a plurality of third programmable controllers corresponding in number to the number of similar ancillary equipment groups;

means delivering signals commensurate with the monitored operating parameters of each ancillary equipment group to respective of said programmable controllers of said third plurality;

means delivering said command signals from said first programmable controller to said programmable controllers of said third plurality, said controllers of said third plurality of each generating operational status and control signals for its associated equipment group in response to the operating parameter signals and to an input command signal in accordance with stored instructions;

means for delivering the signals commensurate with those monitored operating parameters which relate to the safety of operation of each equipment group to its associated controller of said third plurality, said controllers of said third plurality each generating operation termination signals commensurate with actual and potential violation of safe operating conditions of the ancillary equipment group in response to said safety related operating parameter signals and in accordance with stored instructions;

means for delivering the signals commensurate with those monitored operating parameters which relate to the safety of operation of another ancillary equipment group of each of said programmable controllers of said third plurality, said controllers of said third plurality each also generating operation termination signals commensurate with actual and potential violation of safe operating conditions of a second ancillary equipment group in response to said safety related operating parameter signals and in accordance with stored instructions, said delivering means insuring that the safety of operation of each ancillary equipment group is redundantly checked by a pair of programmable controllers of said third plurality;

means for comparing the operation termination signals pertaining to each ancillary equipment group as generated by a pair of programmable controllers of said third plurality, said comparing means providing an indication of any discrepancy between the signals commensurate with actual and potential violation of safe operating conditions for an individual equipment group; and means delivering the operational status signals generated by said programmable controllers of said third plurality to said first programmable controller.

2. The control system of claim 1 wherein the apparatus is a coal fired vapor generator and wherein said equipment groups comprise coal mills, said programmable controllers of said third plurality each comprising:

a logic processor, said logic processor receiving input signals commensurate with a plurality of monitored operating parameters of an associated coal mill and a command signal from said first programmable controller and generating signals which control the start-up and shut-down of the associated coal mill, said logic processor further receiving said shut-down signals from said first and second programmable controllers and generating a coal mill operation termination signal when either of said first and second controller generated shut-down signals indicate that an unsafe condition for continued operation of the control mill has been approached, said logic processor additionally receiving signals commensurate with monitored operating parameters relating to the safety of operation of a further coal mill and in response thereto and to said first and second programmable controller generated shut-down signals generating a coal mill operation termination signal for the further coal mill when an unsafe condition for continued operation of the further coal mill is approached.

3. The control system of claim 2 wherein said vapor generator includes warm-up equipment and means for sensing the status of said warm-up equipment and generating signals commensurate therewith, said second programmable controller comprising:

a logic processor, said logic processor receiving the signals commensurate with the status of the warm-up equipment and a command signal from said first programmable controller and generating control signals for said warm-up equipment to cause an initial warming up of the vapor generator prior to start-up of any coal mill, said warm-up control logic processor also receiving the signals commensurate with the conditions which influence the safety of operation of the vapor generator and in response thereto generating a shut-down signal when an unsafe operating condition for the vapor generator is approached; and means delivering said signals commensurate with the sensed status of said warm-up equipment to said warm-up control logic processor.

4. The control system of claim 3 wherein said first programmable controller comprises:

a further logic processor, said further logic processor receiving said signals commensurate with the operational status of the individual coal mills as provided by said logic processors of said third plurality and the signals commensurate with conditions which influence the safety of operation of the vapor generator and generating coal mill start-up and shut-down initiation command signals for application to the logic processors of said third plurality in a sequence determined by said further logic processor stored instructions, said further logic processor also generating a shut-down signal when said signals commensurate with conditions which influence the safety of operation of the vapor generator indicate an unsafe operating condition has been approached, said further logic processor shut-down signal generation by said further logic processor consisting of a redundant check on the shut-down signal generated by said warm-up control logic processor.

5. The control system of claim 4 further comprising:

means responsive to load demands on the vapor generator for modulating the output of the individual control mills which are in service subsequent to completion of the start-up sequence controlled by said logic processors of said third plurality.

* * * * *

UNITED STATES PATENT AND TRADEMARK OFFICE

CERTIFICATE OF CORRECTION

PATENT NO. : 4,015,548

DATED : April 5, 1977

INVENTOR(S) : Jack A. Schuss

It is certified that error appears in the above-identified patent and that said Letters Patent are hereby corrected as shown below:

Column 2, line 23, after "invention" insert --,-- (comma)

Column 12, line 9, change "by" to --in--

Column 12, line 28, change "output" to --input--

Column 14, line 13, (Claim 1, line 48) cancel "of" (second occurrence)

Column 14, line 31, (Claim 1, line 66) change "of" (first occurrence) to --to--

Signed and Sealed this

*fifth* Day of *July 1977*

[SEAL]

*Attest:*

RUTH C. MASON
*Attesting Officer*

C. MARSHALL DANN
*Commissioner of Patents and Trademarks*